US010220245B1

(12) United States Patent
Halen

(10) Patent No.: US 10,220,245 B1
(45) Date of Patent: Mar. 5, 2019

(54) AUXILIARY FOAM ROLLER EXERCISE SUPPORT APPARATUS

(71) Applicant: Howard Halen, West Hills, CA (US)

(72) Inventor: Howard Halen, West Hills, CA (US)

( * ) Notice: Subject to any disclaimer, the term of this patent is extended or adjusted under 35 U.S.C. 154(b) by 0 days.

(21) Appl. No.: 15/430,476

(22) Filed: Feb. 11, 2017

Related U.S. Application Data

(60) Provisional application No. 62/294,742, filed on Feb. 12, 2016.

(51) Int. Cl.
*A63B 21/00* (2006.01)
*A63B 22/20* (2006.01)

(52) U.S. Cl.
CPC ..... *A63B 21/4039* (2015.10); *A63B 22/20* (2013.01)

(58) Field of Classification Search
CPC ..... A63B 21/40; A63B 22/02
USPC ..... 482/51, 66–68, 128–132
See application file for complete search history.

(56) References Cited

U.S. PATENT DOCUMENTS 4,362,311 A * 12/1982 Bergman ..... A61G 5/00 280/250.1
4,684,149 A * 8/1987 Meyer ..... A61G 5/08 280/250.1
5,299,824 A * 4/1994 Roberts ..... A61G 5/10 108/44
6,182,313 B1 * 2/2001 Eschenbach ..... A47G 9/10 5/637
6,547,265 B1 * 4/2003 Enge ..... A61G 5/1002 135/66
6,676,139 B1 * 1/2004 Saccani ..... B62B 3/14 280/33.991
7,104,552 B2 * 9/2006 Swanson ..... B62B 3/1496 280/33.991
7,213,819 B2 * 5/2007 Carbonero ..... A63C 17/0033 280/32.6
8,844,947 B1 * 9/2014 Whiteside ..... B25H 5/00 280/32.6
8,899,604 B2 * 12/2014 Orenstein ..... A63C 17/0026 280/200
2005/0189731 A1 * 9/2005 Swanson ..... B62B 3/1496 280/33.991
2011/0219991 A1 * 9/2011 Abel ..... A47B 7/02 108/42
2014/0110983 A1 * 4/2014 Sander ..... A47C 1/03255 297/284.1
2014/0217690 A1 * 8/2014 Schumaker ..... B62B 3/005 280/47.35

(Continued)

*Primary Examiner* — Garrett K Atkinson
(74) *Attorney, Agent, or Firm* — Lazaris IP

(57) ABSTRACT

An auxiliary foam roller exercise support apparatus including a trapezoidal platform with an open center area, a left longitudinal side, a right longitudinal side, an open front side, and a rear longitudinal side. A flexible cover over the open center area enables a user to rest his or her head and neck while exercising with a foam roller. Each of a left front leg and a right front leg of a pair of front legs has a handle at the top, a wheel at the bottom, and is attached to the trapezoidal platform. Each of a left rear leg and a right rear leg of a pair of rear legs also has a wheel at the bottom and is attached to the rear longitudinal side of the trapezoidal platform. A pair of cross beams support the apparatus and connect at each of the bottom of the pair of front legs and the pair of rear legs.

3 Claims, 5 Drawing Sheets

(56) References Cited

U.S. PATENT DOCUMENTS

| | | | | |
|---|---|---|---|---|
| 2014/0265184 | A1* | 9/2014 | Lorenzo Rodriguez | B62B 3/1492<br>280/33.991 |
| 2014/0346757 | A1* | 11/2014 | Fine | B62B 5/0003<br>280/651 |
| 2015/0053652 | A1* | 2/2015 | Peters | B62B 3/14<br>219/74 |
| 2016/0297461 | A1* | 10/2016 | Barr-Perea | B62B 3/1464 |

* cited by examiner

AUXILIARY FOAM ROLLER EXERCISE SUPPORT APPARATUS

CROSS-REFERENCE TO RELATED APPLICATIONS

U.S. Provisional Application No. 62/294,742 Filed Feb. 12, 2016

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The art of massage has long been used to relieve various nerves, tendon, muscle, skeletal, and other connective tissue ailments. The kneading of muscle imparts a modification to the muscle tissue. This modification acts beneficially on the nerves, tendons, muscle, skeletal, and other connective tissue, due to improved blood circulation. When trying to relieve nerve, tendon, muscle, skeletal, and other connective tissue discomfort in the back and hips, one might use a massage or foam roller. While using a massage or foam roller, a user is lying supinated, on his back, perpendicular to the massage roller. During this process, there is no support for the user's cervical spine, neck, or head. Rather, the user must rely on the muscle of his cervical spine or support the head and cervical spine with his hands. This lack of support for the spine, neck, or head causes great discomfort when using a massage roller for back and hip relief.

Accordingly, an apparatus is needed that is particularly effective in relieving the pain and discomfort associated with the cervical spine and head support during the use of a massage roller. Thus, what has been needed is an auxiliary foam roller exercise support apparatus including a trapezoidal platform with an open center area, a left longitudinal side, a right longitudinal side, an open front side, a left front corner, a right front corner, a rear longitudinal side, a left rear corner, a right rear corner, and a cross member. What has also been needed is a flexible cover disposed atop the open area of the trapezoidal platform. Each of a left front leg and a right front leg of a pair of legs has handlebars at a top end and wheels at a bottom end, while each of a pair of rear legs is affixed to the rear longitudinal side of the trapezoidal platform. What has finally been needed is a pair of cross beams attaching each of the lower legs. The auxiliary foam roller exercise support apparatus thus enables a user to align his or her head, neck and spin while exercising with a foam roller.

FIELD OF THE INVENTION

The present invention relates to exercise apparatus, and more particularly, to an auxiliary foam roller exercise support apparatus.

SUMMARY OF THE INVENTION

The general purpose of the auxiliary foam roller exercise support apparatus, described subsequently in greater detail, is to provide an auxiliary foam roller exercise support apparatus that has many novel features that result in an exercise apparatus that is not anticipated, rendered obvious, suggested, or even implied by prior art, either alone or in combination thereof.

To accomplish this, the auxiliary foam roller exercise support apparatus includes a trapezoidal platform with an open center area, a left longitudinal side, a right longitudinal side, an open front side, a left front corner, a right front corner, a rear longitudinal side, a left rear corner, a right rear corner, and a cross member disposed between the left longitudinal side and right longitudinal side. The rear longitudinal side may be equal in length to the open front side and, alternately, approximately half the length of the open front side. A flexible cover covers the open center area of the trapezoidal platform and is attached to each of the left longitudinal side and the right longitudinal side. The flexible cover thus provides a user with both head and neck support during exercise.

Each of a left front leg and a right front leg has a lower portion, a mid-portion and an upper portion. The mid-portion of the left front leg is affixed to the front left corner of the trapezoidal platform, and the mid-portion of the right front leg is affixed to the front right corner of the trapezoidal platform. One of a pair of handlebars is disposed on the upper portion of one of the left front leg and the right front leg, and one of a pair of mobile wheels is rotatably attached to the lower portion of one of the left front leg and the right front leg.

Each of a left rear leg and a right rear leg has a lower end and an upper end. The upper end of the left rear leg is affixed to the left rear corner of the trapezoidal platform, and the upper end of the right rear leg is affixed to the right rear corner of the trapezoidal platform. Additionally, one of a pair of rear wheels is affixed to one of the lower left rear leg and the lower right rear leg. Each of the left front leg, the right front leg, the left rear leg, and the right rear leg is freely rotatable in any direction.

A pair of cross beams includes a first cross beam and a second crossbeam. The first cross beam is affixed to the lower end of each of the left rear leg and the right front leg, and the second cross beam is affixed to the lower end of each of the right rear leg and the left front leg.

Thus has been broadly outlined the more important features of the auxiliary foam roller exercise support apparatus so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
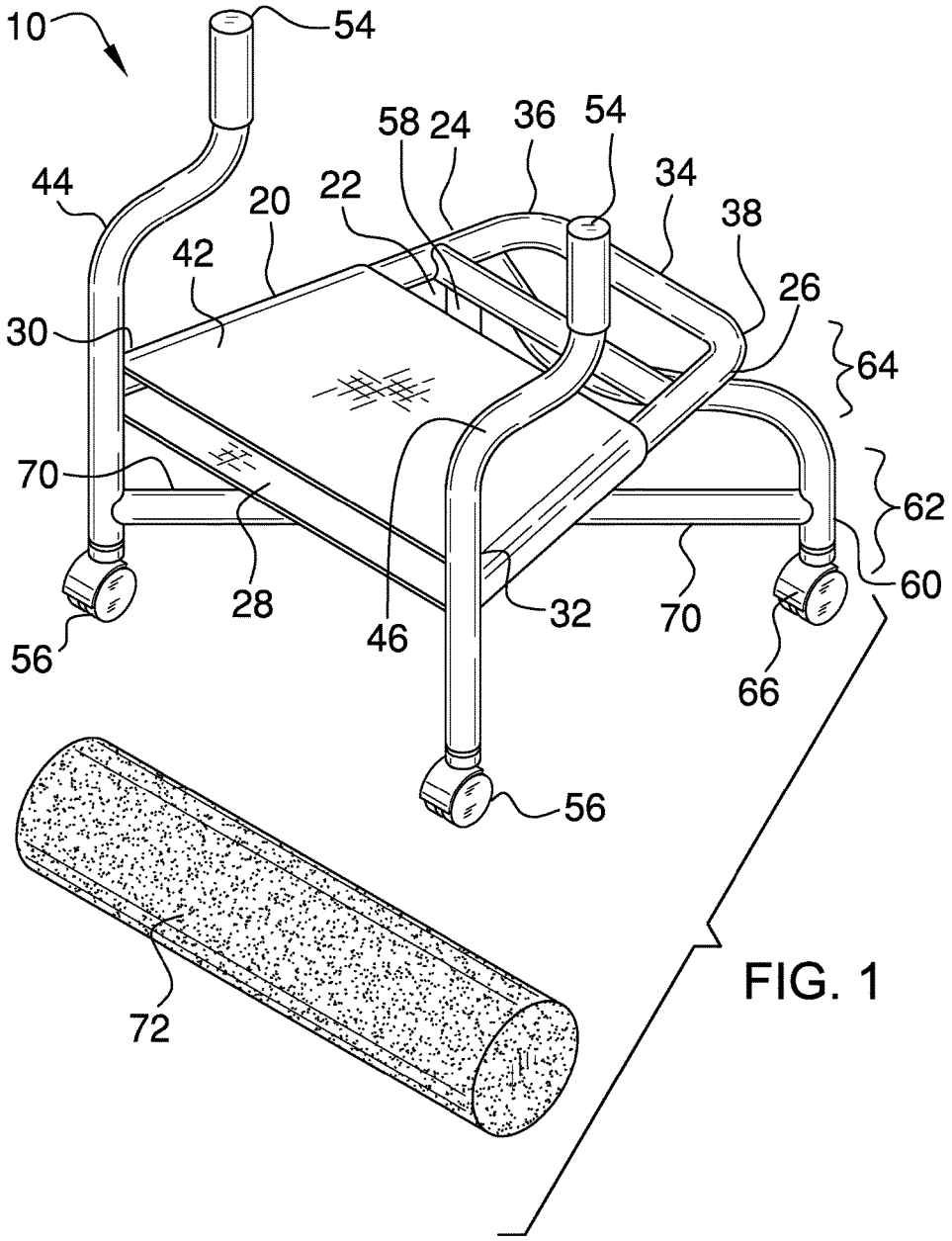
FIG. 1 is an isometric view showing the apparatus and foam roller.
Figure 2:
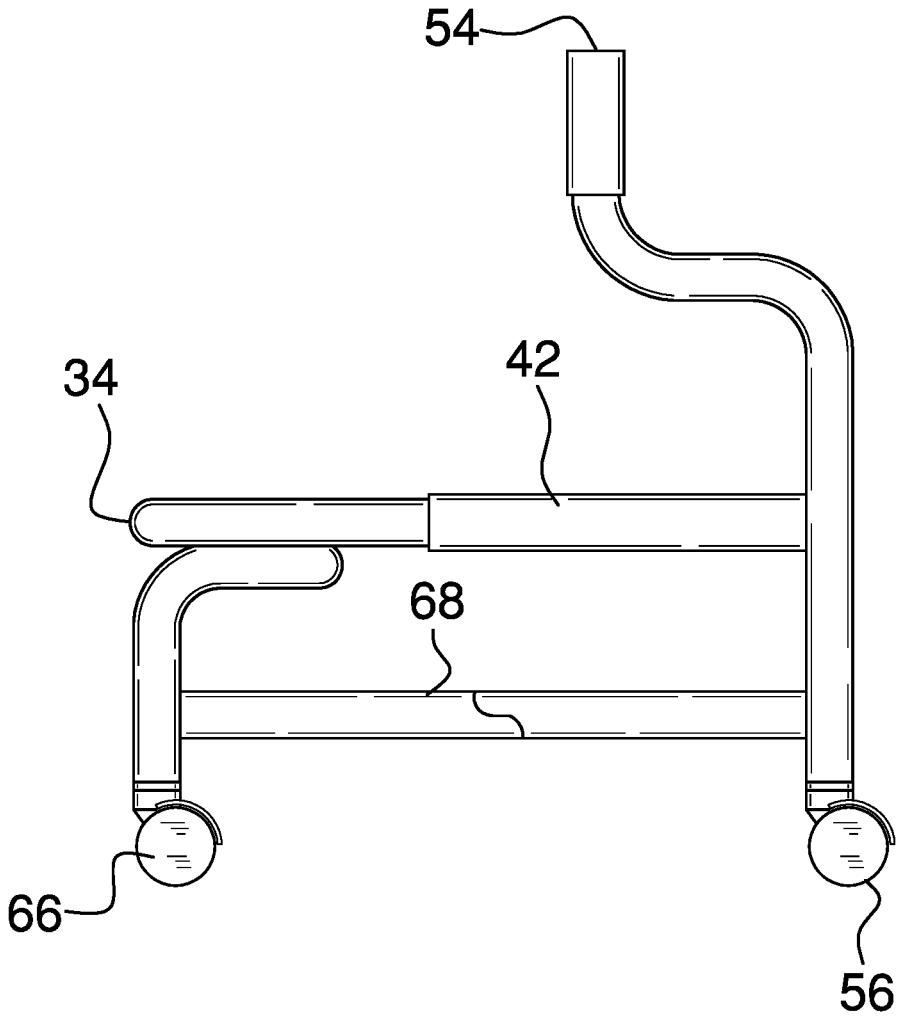
FIG. 2 is a side view.
Figure 3:
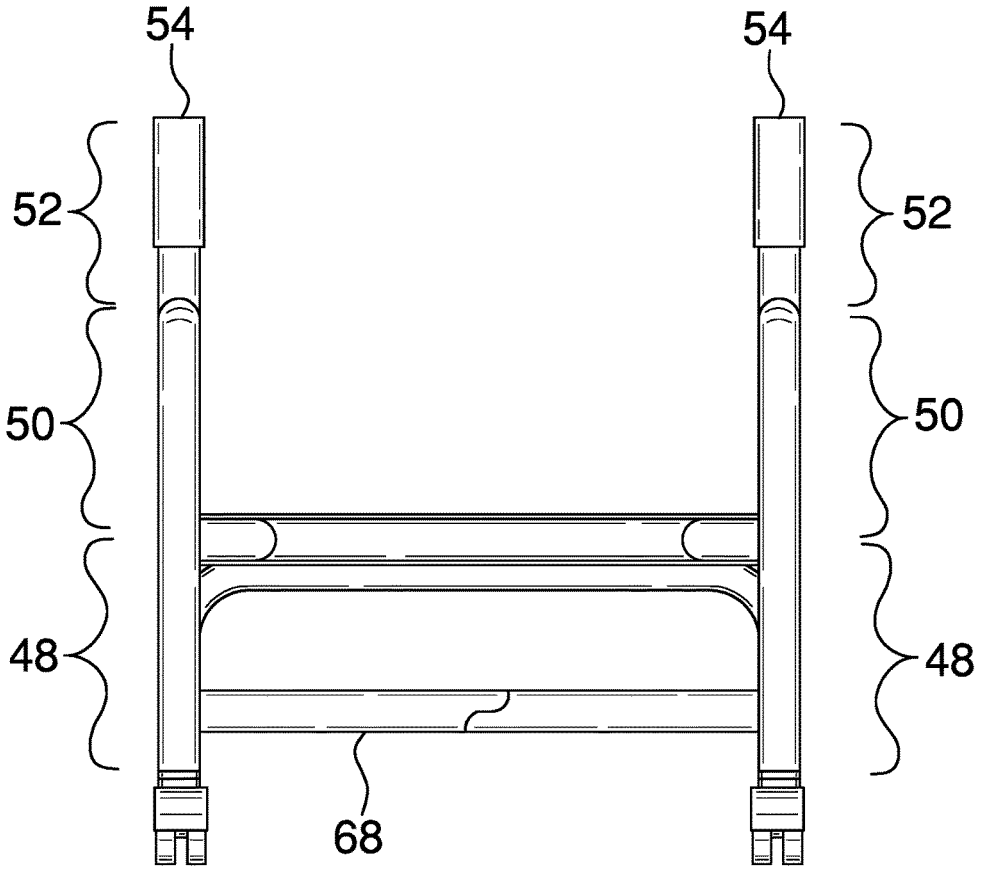
FIG. 3 is a front view.
Figure 4:
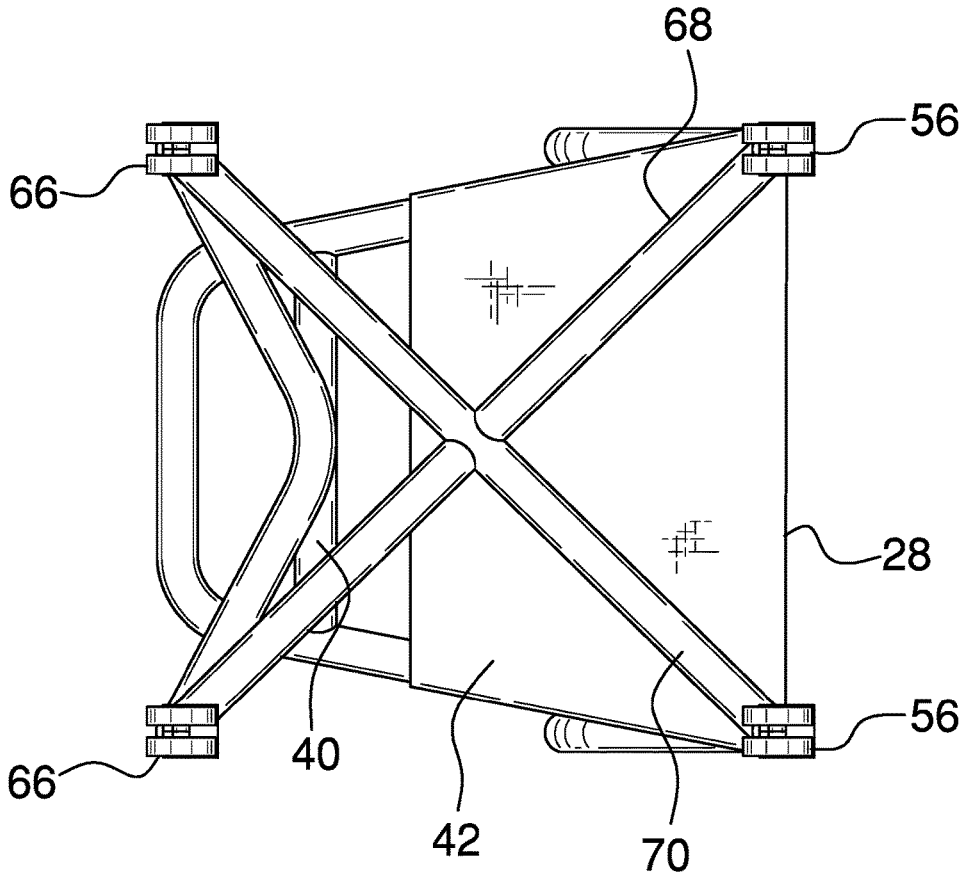
FIG. 4 is a bottom view.
Figure 5:
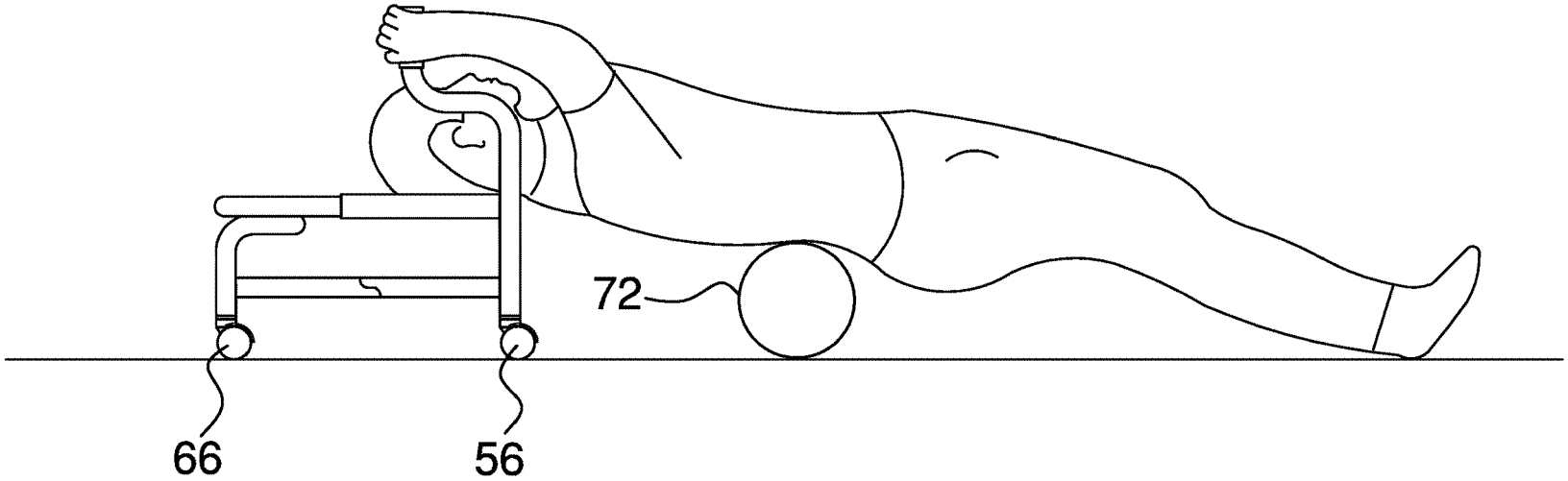
FIG. 5 is side view showing the apparatus in use.

With reference now to the drawings, and in particular FIGS. 1 through 5 thereof, an example of the auxiliary foam roller exercise support apparatus employing the principles and concepts of the present auxiliary foam roller exercise support apparatus and generally designated by the reference number 10 will be described.

Referring to FIGS. 1 through 5 the present auxiliary foam roller exercise support apparatus 10 is illustrated. The auxiliary foam roller exercise support apparatus 10 includes a trapezoidal platform 20 with an open center area 22, a left longitudinal side 24, a right longitudinal side 26, an open front side 28, a left front corner 30, a right front corner 32, a rear longitudinal side 34, a left rear corner 36, a right rear corner 38, and a cross member 40 disposed between the left longitudinal side 24 and right longitudinal side 26. The rear longitudinal side 34 may be equal in length to the open front side 28 and, alternately, approximately half the length of the open front side 28. A flexible cover 42 covers the open center area 22 of the trapezoidal platform 20 and is attached to the left longitudinal side 24 and the right longitudinal side 26. Each of a left front leg 44 and a right front leg 46 has a lower portion 48, a mid-portion 50 and an upper portion 52. The mid-portion 50 of the left front leg 44 is affixed to the left front corner 30 of the trapezoidal platform 20, and the mid-portion 50 of the right front leg 46 is affixed to the right front corner 32 of the trapezoidal platform 20. One of a pair of handlebars 54 is disposed on the upper portion 52 of one of the left front leg 44 and the right front leg 46, and one of a pair of mobile wheels 56 is rotatably attached to the lower portion 48 of one of the left front leg 44 and the right front leg 46.

Each of a left rear leg 58 and a right rear leg 60 has a lower end 62 and an upper end 64. The upper end 64 of the left rear leg 58 is affixed to the left rear corner 36 of the trapezoidal platform 20, and the upper end 64 of the right rear leg 60 is affixed to the right rear corner 38 of the trapezoidal platform 20. One of a pair of rear wheels 66 is affixed to the lower end 62 of one of the left rear leg 58 and the right rear leg 60.

A pair of cross beams includes a first cross beam 68 and a second cross beam 70. The first cross beam 68 is affixed to the lower end 62 of each of the left rear leg 58 and the right front leg 46, and the second cross beam 70 is affixed to the lower end 62 of each of the right rear leg 60 and the left front leg 44.

The auxiliary foam roller exercise support apparatus 10 thus enables a user to better exercise with a foam roller 72.

What is claimed is:

1. An auxiliary foam roller exercise support apparatus comprising:

a trapezoidal platform having an open center area, a left longitudinal side, a right longitudinal side, an open front side, a left front corner, a right front corner, a rear longitudinal side, a left rear corner, a right rear corner, and a cross member disposed between the left longitudinal side and the right longitudinal side, wherein the rear longitudinal side is approximately half a length of the open front side;

a flexible cover disposed on the open center area of the trapezoidal platform and attachable to each of the left longitudinal side and the right longitudinal side;

a pair of front legs comprising a left front leg and a right front leg, each of the left front leg and the right front leg having a lower portion, a mid-portion, and an upper portion, wherein the mid-portion of the left front leg is attachable to the left front corner of the trapezoidal platform, and the mid-portion of the right front leg is attachable to the right front corner of the trapezoidal platform;

a pair of handle bars, wherein one handle bar of the pair of handle bars is disposed upwardly near the upper portion of the left front leg, and the other of the handle bars in the pair of handles is disposed upwardly near the upper portion of the right front leg in raised positions extending above the trapezoidal platform and separated from each other, wherein the pair of handle bars are held by a user during performance of an exercise motion, with at least the user's head supported on the flexible cover;

a pair of front mobile wheels, wherein one of the pair of front mobile wheels is disposed on the lower portion of one of the left front leg and right front leg;

a pair of rear legs comprising a left rear leg and a right rear leg, each of the left rear leg and the right rear leg having a lower end and an upper end, wherein the upper end of the left rear leg is attachable to the rear left corner of the trapezoidal platform, and the upper end of the right rear leg is attachable to the rear right corner of the trapezoidal platform;

a pair of rear wheels, wherein one of the pair of rear wheels is disposed on the bottom portion of one of the left rear leg and right rear leg; and a pair of cross beams comprising a first cross beam and a second cross beam, wherein the first cross beam is attachable to the lower end of each of the left rear leg and the right front leg, and the second cross beam is attachable to the lower end of each of the right rear leg and the left front leg.

2. The auxiliary foam roller exercise support apparatus of claim 1 wherein the pair of front mobile wheels and the pair of rear wheels allow the user to move relative to a separate massaging portion during the performance of the exercise motion.

3. The auxiliary foam roller exercise support apparatus of claim 1 wherein the massaging portion is a foam roller.

* * * * *